United States Patent [19]

Newell

[11] Patent Number: 4,470,401

[45] Date of Patent: Sep. 11, 1984

[54] VALVE FOR FURNACE STACK PIPE

[76] Inventor: John H. Newell, 227 Manitou Way, Ancaster, Ontario, Canada, L9G 1Y1

[21] Appl. No.: 264,087

[22] Filed: May 15, 1981

[51] Int. Cl.[3] ..... F23L 3/00

[52] U.S. Cl. ..... 126/293; 98/48; 126/312

[58] Field of Search ..... 126/285 R, 293, 312, 126/289, 290; 236/16; 237/46, 47, 48; 98/48

[56] References Cited

U.S. PATENT DOCUMENTS

| | | | |
|---|---|---|---|
| 105,215 | 7/1870 | Janes | 98/48 |
| 124,931 | 3/1872 | Boore | 126/293 |
| 607,669 | 7/1898 | Underwood | 126/293 |
| 2,035,974 | 3/1936 | McWilliams | 126/293 |
| 2,046,318 | 7/1936 | Brubaker . | |
| 2,112,955 | 4/1938 | Downs | 98/101 |
| 2,200,248 | 5/1940 | Hoffman | 126/293 |
| 2,220,630 | 11/1940 | Trethewey | 236/16 |
| 2,224,705 | 12/1940 | Stringer . | |
| 2,264,590 | 12/1941 | Sabins . | |
| 2,309,295 | 1/1943 | Barnes . | |
| 2,437,878 | 3/1948 | Dunville . | |
| 2,508,885 | 5/1950 | Mackay | 126/293 |
| 2,554,370 | 5/1951 | Martin . | |
| 2,603,411 | 7/1952 | Trumpa . | |
| 2,604,090 | 7/1952 | Martin . | |
| 2,744,689 | 5/1956 | Coselman . | |
| 2,793,811 | 5/1957 | Coselman . | |
| 3,168,088 | 2/1965 | Martin et al. . | |
| 3,273,625 | 9/1966 | Holtzman | 126/293 |
| 3,951,051 | 4/1976 | Dry . | |
| 4,108,369 | 8/1978 | Prikkel . | |
| 4,138,060 | 2/1979 | Iacono . | |
| 4,155,699 | 5/1979 | Hansen . | |
| 4,177,716 | 12/1979 | Bowe | 126/285 R |
| 4,184,837 | 1/1980 | Manning . | |
| 4,193,541 | 3/1980 | Scheidweiler . | |
| 4,335,704 | 6/1982 | Wingstrom | 126/293 |

*Primary Examiner*—Daniel J. O'Connor
*Attorney, Agent, or Firm*—Lyon & Lyon

[57] ABSTRACT

A valve for provided for installation in the auxillary duct of a furnace stack pipe. The valve prevents flow of air through the damper plate in the auxillary duct when the furnace is switched off. The valve is controlled by a temperature responsive bimetallic strip which is impinged upon by flue gases to move the valve to an open position upon the furnace being ignited and producing combustion gases.

22 Claims, 8 Drawing Figures

VALVE FOR FURNACE STACK PIPE

The invention relates to furnace installations and in particular to methods of reducing the inefficiency of such installations.

It is conventional practice to provide a furnace for a house in which a combustible product such as gas, oil or solid fuel is combined in a combustion chamber and the heat produced by the combustion used to heat a house. The waste products of combustion are usually removed from the furnace by means of a stack pipe which extends from the furance to the exterior of the building in which the furance is located. It is also usual to provide a secondary air flow into the stack pipe to accommodate variations in the draft in the stack pipe and ensure optimum atmospheric conditions at the combustion chamber. The secondary air is usually provided through an auxiliary duct which intersects the stack pipe and has a swinging damper to control the secondary air flow through the duct. The damper is pivotally mounted in the auxiliary duct and is biased to a closed position by means of a weight. The weight is calibrated to provide the required resistance of opening of the damper plate so that a negative pressure is required in the stack pipe to induce air flow through the auxiliary duct.

It has been recognized that the stack pipe constitutes a significant heat loss when the furnace is in an inoperative condition. Air is induced through the furnace and up through the stack pipe so that heated air is lost from the building. It has previously been proposed to place a value in the stack pipe which is operated by the furnace controls. Upon the furnace being switched off, the valve is allowed to return to a closed position and upon the furnace being switched on, the valve is moved to an open position. However, such an arrangement has the disadvantage that if the valve malfunctions, the products of combustion will be forced into the buildiing creating a very hazardous environment. As such therefore the proposed valves have not been widely accepted and are not considered a desirable addition to the furnace.

It has now been recognized that a significant heat loss may be attributed to the auxiliary air duct as small changes in the pressure within the stack pipe moves the damper plate and allow air to flow through the auxiliary duct. In order for the damper plate to operate correctly, it must be sensitive to small variations in pressure changes within the stack pipe and is therefore also sensitive to pressure changes which are induced by external influences.

It is therefore an object of the present invention to obviate or mitigate the above disadvantages.

According therefore to the present invention there is provided a furnace installation comprising a furnace having an air inlet and a combustion chamber, a stack pipe to remove combustion products from said combustion chamber, said stack pipe comprising a primary duct extending from said furnace to the outlet of said stack pipe and an auxiliary duct intersecting said primary duct intermediate said furnace and said outlet and communicating with the exterior of said stack pipe to permit air to flow from into said primary duct to compensate for variations in draft in said stack pipe, and valve means operable to control flow of air through said auxiliary duct, said valve means including a valve member movable from a closed position, in which flow through said auxiliary duct is inhibited, to an open condition in which flow is permitted, and control means to control said valve member for movement between said open and closed positions, said control means being operable to hold said valve member in said closed position when said furnace is in an inoperative condition and to permit said valve member to move to said open position upon said furnace being conditioned to operate, whereby flow if air through said auxiliary duct is inhibited when said furnace is inoperative.

An embodiment of the invention will now be described by way of example only with reference to the accompanying drawings in which.

Figure 1:
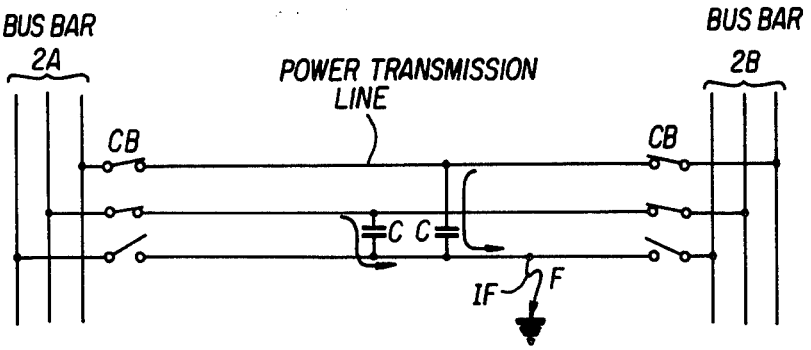
FIG. 1 PRIOR ART
FIG. 1 is a diagrammatic view of a furnace installation.
Figure 2:
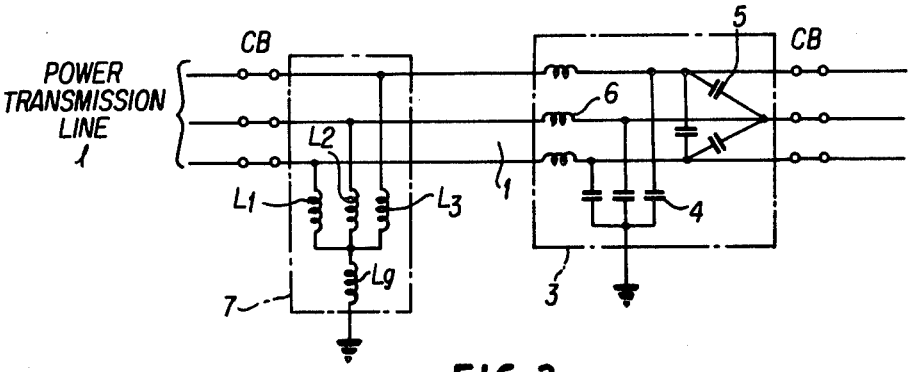
FIG. 2 PRIOR ART
FIG. 2 is a perspective view of a portion of the stack pipe shown in FIG. 1 showing an auxiliary air duct.
Figure 3:
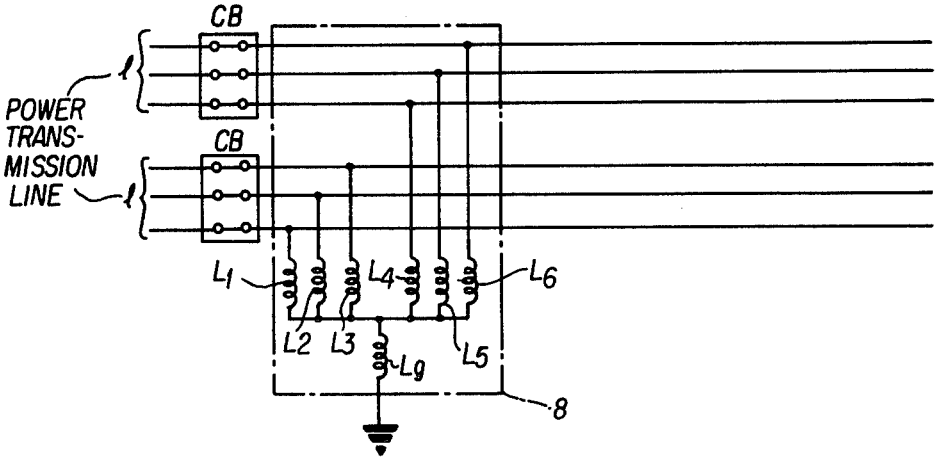
FIG. 3 PRIOR ART
FIG. 3 is a perspective view of a valve assembly shown in FIG. 2 with a portion of the assembly broken away for clarity.
Figure 4:
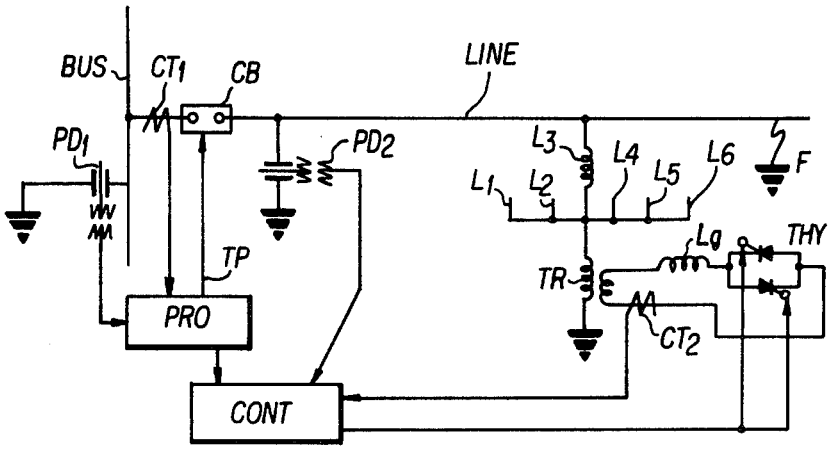
FIG. 4 is a view in a direction of arrow 4, FIG. 3.
Figure 5:
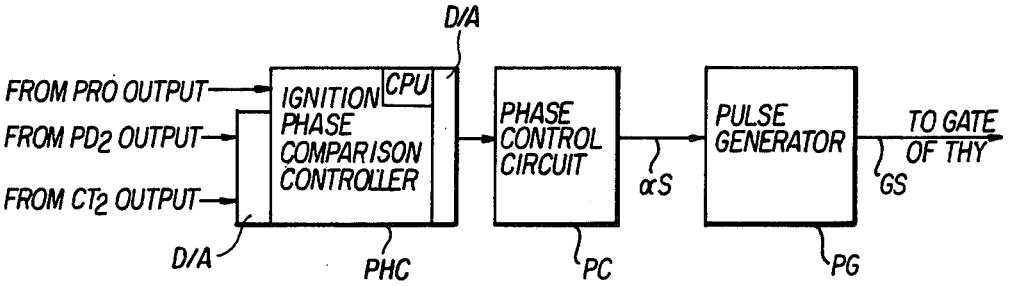
FIG. 5 is a section on line 5—5

Referring now to FIG. 1, a furnace installation 10 includes a blower 12 having an air inlet 14 to supply air to the burner assembly (that is not shown) of a furnace 16. The combustion byproducts of the furnace 16 are removed to the exterior of the building in which the furnace is installed by means of a stack pipe 18. The stack pipe comprises a primary duct 20 which extends from the combustion chamber of the furnace to the exterior of the building and an auxiliary duct 22 intersecting the primary duct to permit air to flow from the interior of the building to the primary duct. As can best be seen in FIG. 2, flow through the auxiliary duct is controlled in part by a damper plate 24 which is pivoted about an axis transverse to the longitudinal axis of the auxiliary duct so as to be swingable and vary the volume of air flowing through the auxiliary duct. The damper plate 24 is of conventional construction whose purpose is to minimize fluctuations in draft occuring in the combustion chamber and will therefore not be described further.

Also located in the auxiliary duct is a shut-off valve assembly 26. The valve assembly 26 comprises a valve support 28 which is formed from a disk 30 and an annular support ring 32. A number of segments are removed from the disk 30 to provide a plurality of ports 34 through which air can flow. A cylindrical reaction member 36 is connected to the central portion of the disks 30 and extends into the primary duct 20.

A bimetallic strip 38 is helically wound and has one end 40 attached to the reaction member 36 and the other end 40 attached to an operating rod 44. The operating rod 44 is also rotatably supported in the disk 30 and is connected by means of a friction clutch 46 to a circular valve plate 48. The valve 48 is rotatably supported in the annular valve support 28 and includes the same number of apertures 50 as there are ports in the disk 30. The segments 52 extending between the apertures 50 also correspond to the number of ports in the disk 30 and are dimensioned so that in one extreme position the valve plate 48, the segments 52 overlie the ports 34 and prevent flow through the shut-off valve assembly whilst in the other extreme position of the valve plate 48, the apertures are aligned with the ports and flow through the shut-off valve assembly is permitted. A stop member 54 projects from one of the edges of the ports 34 to limit the movement of the valve plate 48. The friction clutch 46, which may be of any convenient form, allows slippage between the operating rod 44 and the valve plate 48 upon engagement of the stop member with one of the edges of the apertures 50.

The installation and operation of the shut-off valve assembly 26 is as follows. The auxiliary duct 22 is removed from the stack pipe by releasing the self-tapping screws 56. The shut-off valve assembly 26 is positioned within the auxiliary duct 22 with the valve support ring 28 in sealing relationship with the interior of the auxiliary duct. The shut-off valve assembly is positioned so that the damper plate 24 may swing to its fully opened position without engaging the valve plate. The shut-off valve assembly is retained within the duct by means of a pair of self-tapping screws 58 and the auxiliary duct replaced on the stack pipe 18 and secured with the screws 58. In this position, the reaction member 36 projects into the primary duct so that the bimetallic strip 38 is exposed to the combustion products flowing through the primary duct. With the furnace in an inoperative condition, the valve plate 48 is positioned so that the segments 52 overlie the ports 34. Upon the furnace 16 being switched on, the combustion products impinge upon the bimetallic strip 38 and cause it to rotate the operating rod 44. Rotation of the rod 44 is transmitted through the friction clutch 46 to the valve plate 48 so that the apertures 50 are aligned with the ports 34. This permits air to flow through the auxiliary duct into the primary duct under the control of the damper plate 24. The plate 48 will continue to rotate until it engages the stop member 54. In this position the valve assembly 26 is fully opened so that maximum volume of air may enter the primary duct 20. Any further rotation of the operating rod 44 causes slippage of the friction clutch 46.

Upon the furnace being switched off, the combustion products in the flue will cool and cause the bimetallic strip 38 to rotate the valve plate in the opposite direction. Because the friction clutch permits full rotation of the rod 44 under the influence of the bimetallic strip 38, the valve plate 48 will begin to move immediately the combustion gases cool. The valve plate 48 moves to a fully closed position in which the edge of the aperture 50 engages the stop member 54 and continued cooling of the bimetallic strip will result in slippage between the rod 44 and the valve plate 48. In the fully closed position, air flow through the auxiliary duct is prevented so that variations in the pressure in the duct do not influence the damper plate and do not draw air through the auxiliary duct. Once again, because of the arrangement of the friction clutch 46, the valve plate 48 will be rotated immediately the temperature in the primary duct 20 increases. This arrangement of friction clutch not only ensures an immediate response in the valve plate, but also enables a rapid movement between fully closed and fully opened positions to be obtained as only a part of the movement obtained from the bimetallic strip need be used to move the valve plate between its extreme position.

It will be seen, therefore that as soon as the furnace is switched on, the valve assembly 26 moves to an open position and permits the damper assembly to function in a normal manner. Upon the furnace being switched off the valve assembly 26 operates to close the auxiliary duct and thereby prevent air from the interior of the building being induced through the auxiliary duct into the stack pipe.

Figure 6:
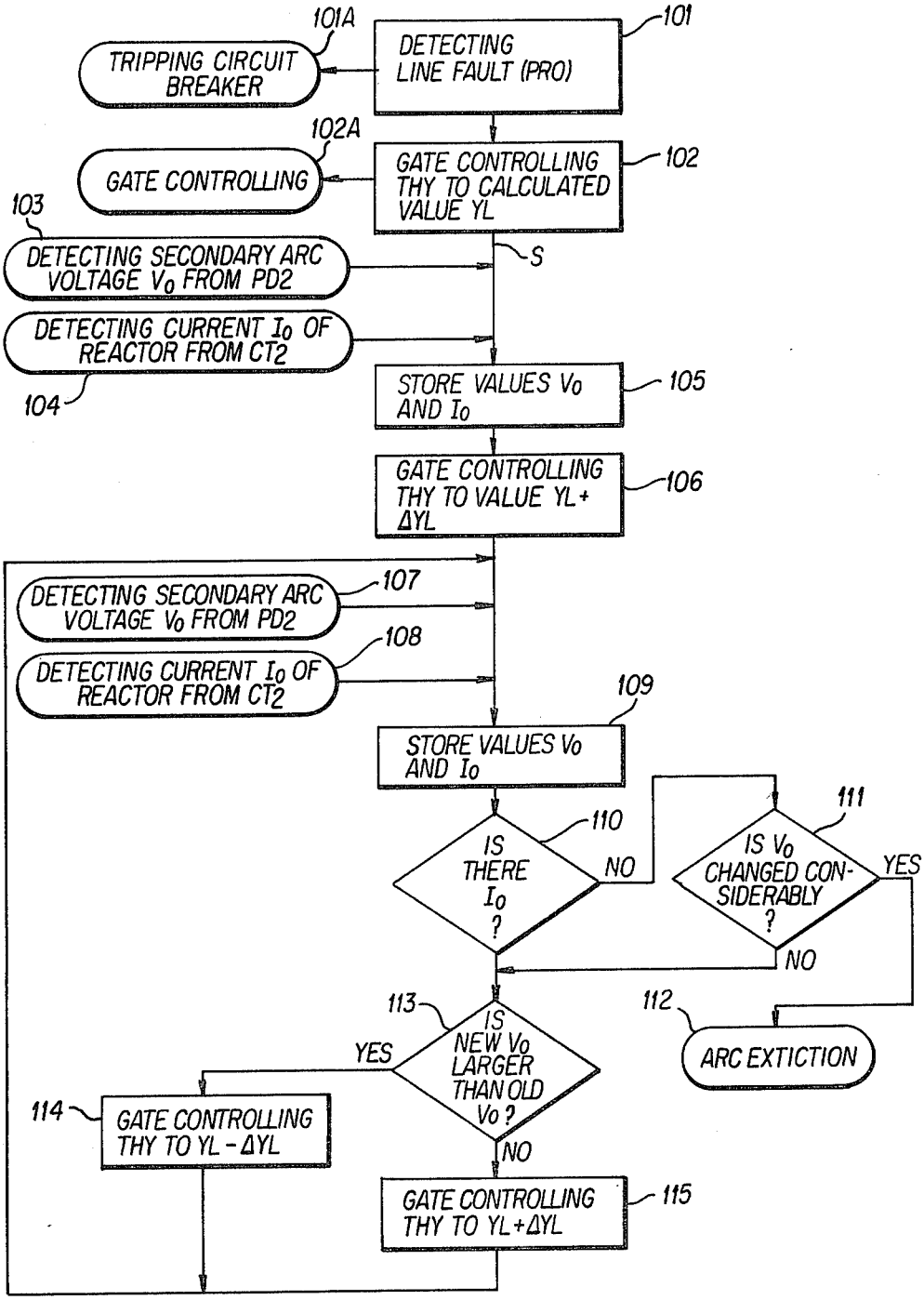
FIG. 6 is a perspective view of a valve assembly for placement on the inlet of the furnace installation shown in FIG. 1 with portions of the valve assembly broken away for clarity.
Figure 1:
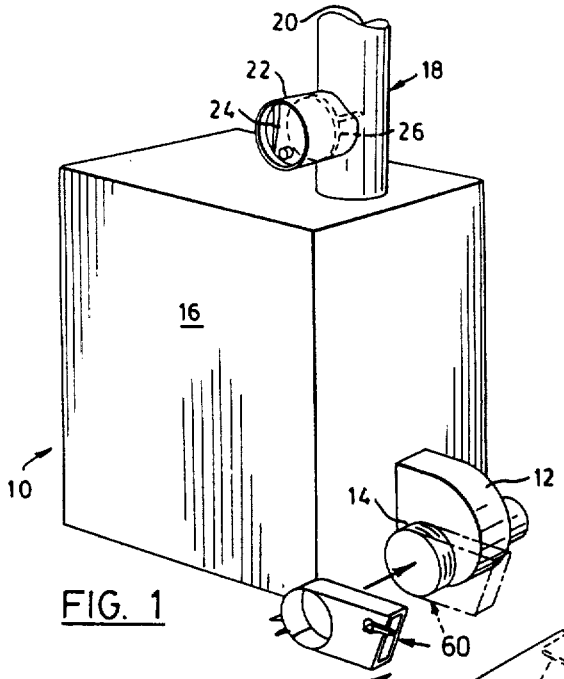
Figure 7:
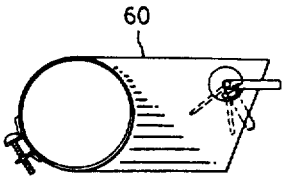
FIG. 7 is a side view of the valve assembly shown in FIG. 6 showing alternate positions of a control member.
Figure 6:
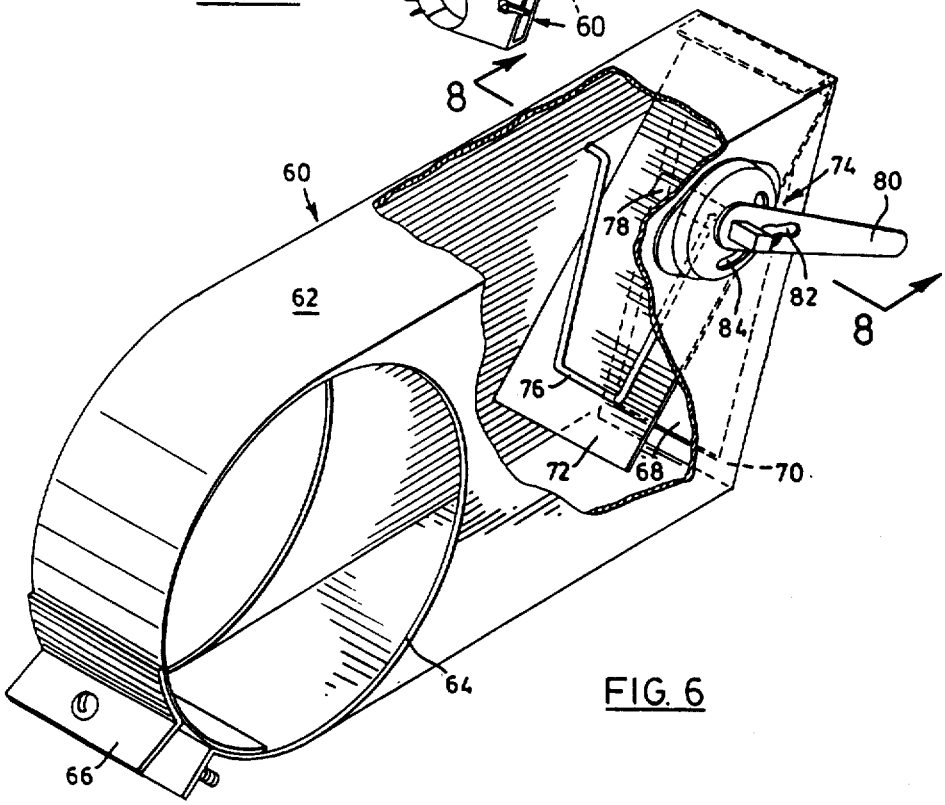
Figure 2:
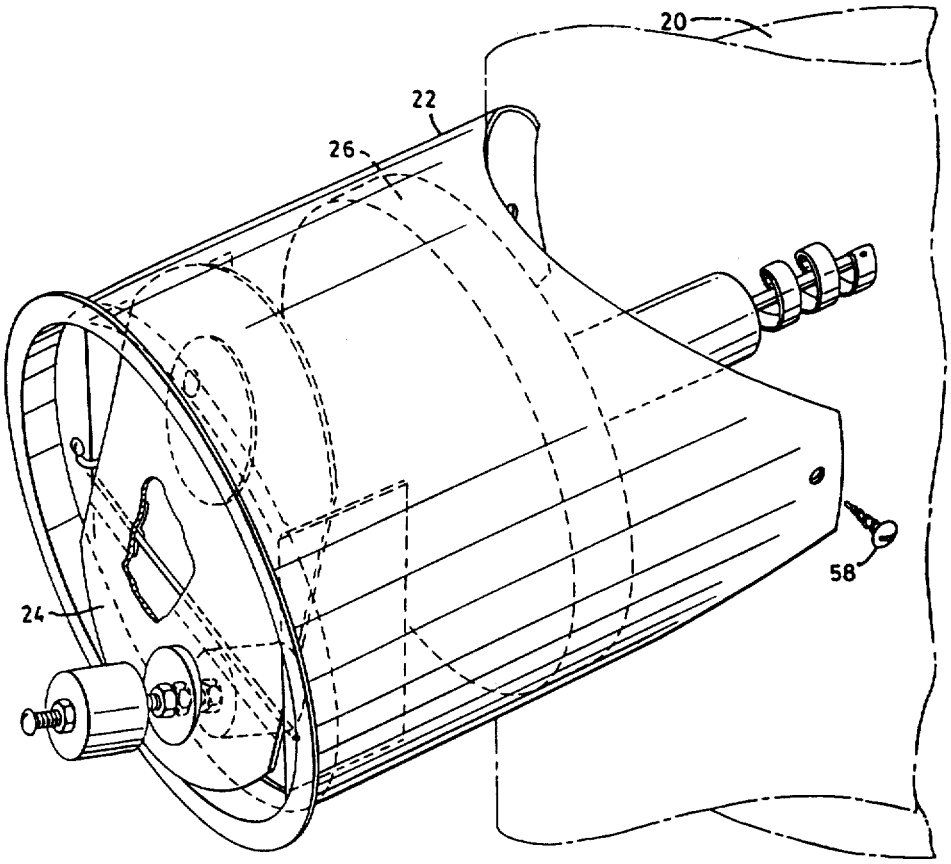
Figure 3:
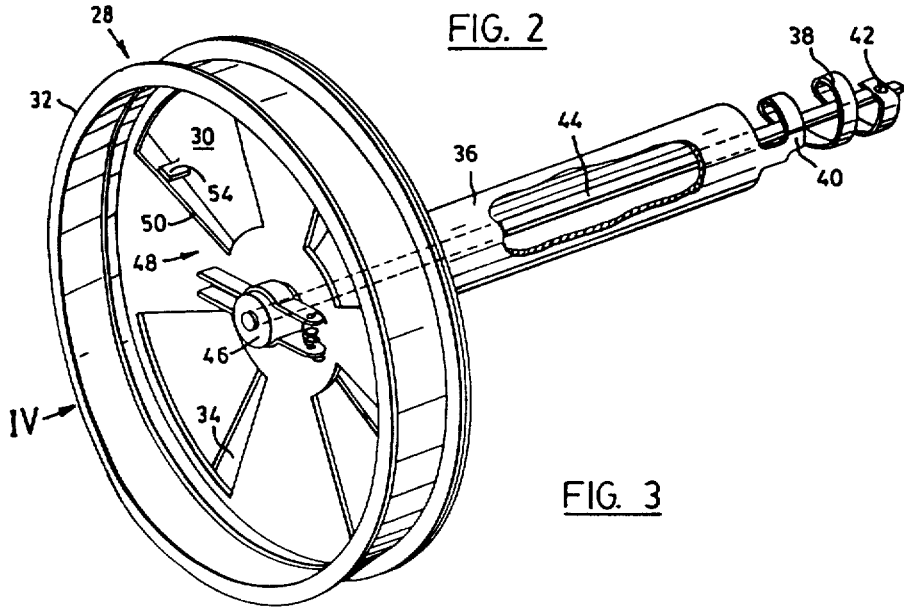
Figure 8:
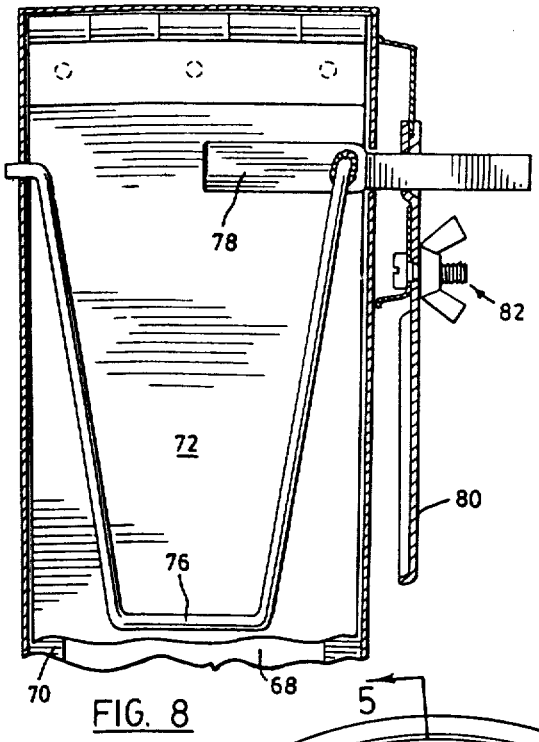
FIG. 8 is a section on the line 8—8 of FIG. 6.
Figure 5:
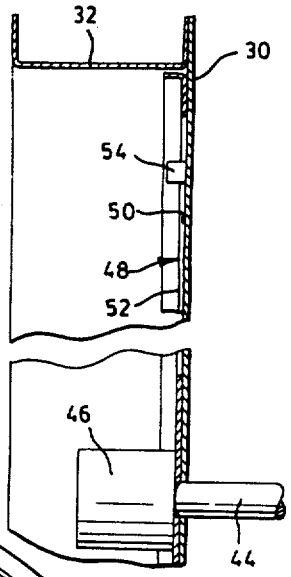
Figure 4:
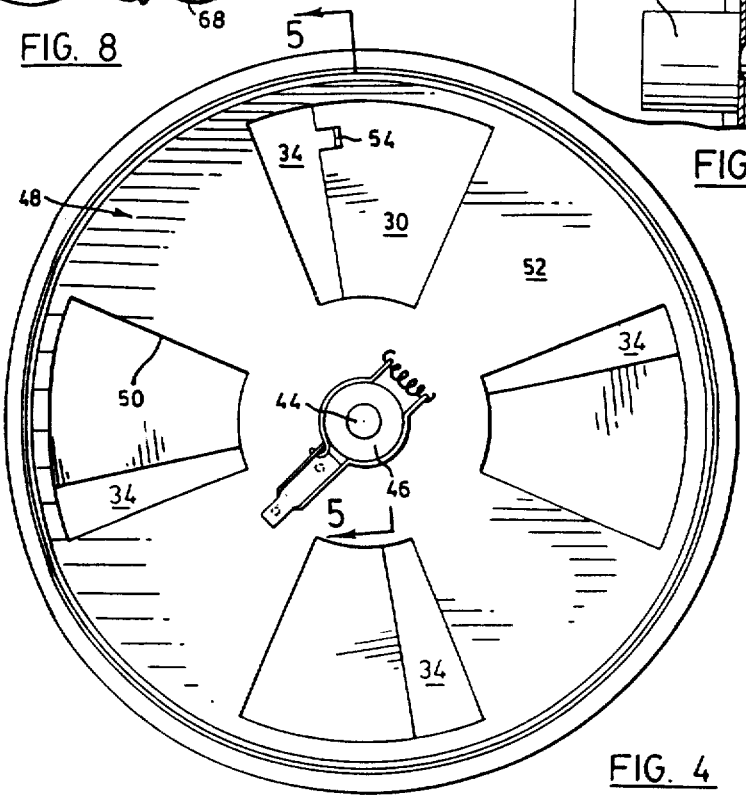

As a further control over the flow of air from the interior to the exterior of the building, the air inlet 14 is also provided with a air control valve, generally designated 60. This may best be seen in FIG. 6 and comprises a tubular body 62 of generally rectangular cross-section. A circular aperture 64 is formed in one end of the body 62 to slip over the air inlet 14. The aperture 64 may be clamped to the air inlet 14 by means of an adjustable band 66 so that the air control valve 60 may be securely attached to the blower unit 12. At the opposite end of the tubular body 64, an inclined air inlet 68 is provided. The periphery of the air inlet 68 is defined by a flange 70. A plate 72 is pivoted to the upper edge of the air inlet 68 within the tubular body 62 and is biased by its own weight to lie in sealing relationship against the flange 70. An adjustable stop mechanism 74 is located on the tubular body in a position to limit the movement of the plate 72 away from the flange 70. The adjustable stop comprises a U-shaped wire hanger 76 which is pivoted to opposite sides of the body 62. Pivotal movement of the wire hanger is controlled by a shaft 78 which is rotatably mounted in the side walls of the tubular body 62. A handle 80 is attached to the shaft and carries a releasable fastener 82 in the form of a wing nut. The head of the wing nut slides in a slot attached to the outer wall of the tubular body 82 so that the handle 80 may be secured in the desired position by tightening the fastener 82.

In operation, the air control valve is attached to the blower unit 12 so that all air entering the furnace must pass through the air inlet 68. With the blower unit switched off, the plate 72 lies against the flange 70 and prevents any flow of air into the furnace. When the blower unit 12 is switched on, air is drawn out of the tubular body which causes the plate to move away from the flange and abut the hanger 76. The hanger is positioned to permit the required flow rate of air to be drawn through the tubular body into the furnace. Upon the furnace being switched off, the plate returns under its own weight to seal against the flange 70 and prevent extraneous air flowing through the air inlet 14 and stack pipe 18.

By combining the shut-off valve assembly and the air control valve 60, it is possible to prevent unnecessary air being induced from the interior of the building through the stack pipe to the exterior. However, both of the valve assemblies are inherently failsafe since malfunction of the shut-off valve assembly 26 will not prevent combustion products flowing through the stack pipe, and jamming of the air control valve 60 in a closed position will not permit the furnace to ignite.

It is of course possible to use either valve assemblies separately. It is also conceivable that the shut-off valve assembly 26 may be operated by means other than the bimetallic strip illustrated such as a solenoid operated by the furnace control. Further, the shut-off valve assembly could be incorporated into the damper plate and a solenoid be provided to operated directly on the damper plate to hold it in the closed position when the furnace is shut off.

It will be appreciated that the valve assembly as exemplified is simple to install and does not require electrical connections in order to function.

What we claim is:

1. A furnace installation comprising a furnace having an air inlet and a combustion chamber, a stack pipe to remove combustion products from said combustion chamber, said stack pipe comprising a primary duct extending from said furnace to the outlet of said stack pipe and an auxiliary duct intersecting said primay duct intermediate said furnace and said outlet and communicating with the exterior of said stackpipe to permit air to flow into said primary duct to compensate for variations in draft in said stack pipe, first valve means responsive to variations the draft in said primary duct to regulate the flow of air through said auxiliary duct during operation of said furnace and second valve means located in said auxiliary duct in series with said first valve means, said second valve means including a support member engaging the interior wall of said auxiliary duct and a valve member movable from a closed position, in which flow through said auxiliary duct is inhibited, to an open position in which flow is permitted, and control means to control said valve member for movement between said open and closed positions, said control means being operable to hold said valve member in said closed position when said furnace is in an inoperative condition and to permit said valve member to move to said open position upon said furnace being conditioned to operate, whereby flow of air through said auxiliary duct is inhibited when said furnace is inoperative regardless of variations in the draft in the primary duct.

2. A furnace installation according to claim 1 wherein said control means is responsive to temperature variations in said primary duct to permit said valve member to move to said open position upon combustion products heating the interior of said stack when said furnace is in an operative condition.

3. A furnace installation according to claim 2 wherein said control means includes a bimetallic strip positioned in said primary duct and operable upon said valve member to move it from said closed to said open positions upon an increase of temperature in said primary duct.

4. A furnace according to claim 3 wherein said valve member is mounted to rotate about an axis parallel to the longitudinal axis of said duct from said closed to said open position and said bimetallic strip is wound about said axis to induce rotation of said valve member upon changes of temperature in said duct.

5. A furnace installation according to claim 4 wherein said valve member includes an operating member connected to said bimetallic strip, a valve plate movable over ports in said auxiliary duct, and a friction clutch between said valve plate and said operating member to limit the movement of said valve plate induced by said bimetallic strip.

6. A furnace installation according to claim 1 wherein said control means is responsive to temperature increases in said stack to cause a motor means to move said valve member to said open position.

7. A furnace installation according to claim 1 wherein said support member includes a plurality of apertures and said valve member is movable to cover and uncover said apertures in said closed and open positions respectively.

8. A furnace installation according to claim 1 wherein a motor means acts between said support member and said valve member.

9. A furnace installation according to claim 8 wherein said motor means and said control means are constituted by a bimetallic member acting between said support and valve members.

10. A furnace installation according to claim 9 wherein said valve member is rotatable with respect to said support member and said bimetallic strip is helically wound to induce rotation of said valve member upon variations in temperature of said stack.

11. A furnace installation according to claim 1 including a lost motion device positioned between said motor and said valve member and stop means are provided to limit movement of said valve member at said open and closed positions, said lost motion device thereby permitting continued movement of said motor upon engagement of said valve member with said stop means.

12. A furnace installation according to claim 11 wherein said lost motion device is a friction clutch interposed between said motor and said valve member.

13. A furnace installation according to claim 1 wherein said valve means including a support member has a disc with a plurality of apertures therein to permit flow of air across said disc, and an annular ring formed around the periphery of said disc to extend in sealing engagement with said duct, a valve member slidably mounted on said disc and having at least one aperture therein, said valve member being movable from a closed position in which apertures in said disc and said valve member are not aligned and flow of air across said valve is inhibited to an open position in which said apertures are aligned to permit airflow across said valve, motor means operable between said valve member and said disc to move said valve member between open and closed positions and control means responsive to temperature variations to operate said motor means to move said valve member toward said open position upon an increase in temperature and toward a closed position upon a decrease in temperature.

14. A furnace installation according to claim 13 wherein said motor means and control means comprise a bimetallic member operable between said valve member and said disc.

15. A furnace installation according to claim 14 wherein said valve member is rotatable mounted on said disc for rotation between said open and closed positions.

16. A furnace installation according to claim 15 wherein said valve member is connected to an axle pivotally supported in said disc, and said bimetallic member is helically wound about said axle and connected at one end to said axle and at the other to said support member whereby variations in temperature induce rotation of said valve members relative to said disc.

17. A furnace installation according to claim 16 including clutch means operable between said axle and said valve members, said clutch means permitting rotation of said spindle independently of said valve member.

18. A furnace installation according to claim 17 wherein stop means are provided between said disc and said support member to prevent movement of said valve member beyond said fully open or said fully closed positions, said clutch means permitting continued rotation of said axle independently of said valve member upon continued operation of said motor means.

19. A furnace installation according to claim 18 including a reaction member extending from said disc and along said axle, said bemetallic member being connected between said reaction member and said axle whereby said bemetallic member is positioned remote from said valve member and is impinged upon by gases in said stack.

20. A furnace installation according to claim 1 wherein said first valve means is a barometric damper responsive to variations in the pressure differential between the interior and exterior of said primary duct.

21. A furnace installation according to claim 20 wherein said control means is responsive to temperature variations in said primary duct to permit said valve member to move to said open position upon combustion products heating the interior of said stack when said furnace is in an operative condition.

22. A furnace installation according to claim 21 including lost mostion means between said valve member and said control means to accommodate continued movement of said control means with continuing temperature variations upon said valve member attaining either said open or closed positions.

* * * * *

UNITED STATES PATENT AND TRADEMARK OFFICE

CERTIFICATE OF CORRECTION

PATENT NO. : 4,470,401

DATED : September 11, 1984

INVENTOR(S) : John H. Newell

It is certified that error appears in the above-identified patent and that said Letters Patent is hereby corrected as shown below:

In the drawing the three (3) sheets of drawing should be deleted to be replaced with three (3) sheets of drawing as shown on the attached sheets but will apply to the Grant Only.

Signed and Sealed this

*First* Day of *April 1986*

[SEAL]

*Attest:*

DONALD J. QUIGG

*Attesting Officer*

*Commissioner of Patents and Trademarks*